US007267745B2

(12) United States Patent
Crook, Jr.

(10) Patent No.: US 7,267,745 B2
(45) Date of Patent: Sep. 11, 2007

(54) PAPERMAKERS FELT HAVING A POINT-BONDED WEB LAYER FORMED OF COARSE FIBERS

(75) Inventor: Robert L. Crook, Jr., Wilson, NC (US)

(73) Assignee: Voith Fabrics, Inc., Wilson, NC (US)

( * ) Notice: Subject to any disclaimer, the term of this patent is extended or adjusted under 35 U.S.C. 154(b) by 477 days.

(21) Appl. No.: 10/934,028

(22) Filed: Sep. 3, 2004

(65) Prior Publication Data

US 2006/0052019 A1 Mar. 9, 2006

(51) Int. Cl.
*D21F 7/08* (2006.01)
*B32B 5/06* (2006.01)
*B32B 37/14* (2006.01)

(52) U.S. Cl. ..... 162/358.2; 162/900; 156/148; 442/270; 442/271; 442/402; 428/218; 428/220; 28/110; 28/142

(58) Field of Classification Search ..... 162/204–207, 162/306, 348, 358.2, 358.4, 900–904, 116, 162/117; 34/114–123; 139/383 A, 425 A; 442/268–271, 402, 403, 50; 428/213, 218, 428/220, 332, 401; 28/110, 142; 156/148
See application file for complete search history.

(56) References Cited

U.S. PATENT DOCUMENTS

| | | | | |
|---|---|---|---|---|
| 3,059,312 | A | | 10/1962 | Jamieson |
| 3,664,905 | A | | 5/1972 | Schuster |
| 3,928,699 | A | * | 12/1975 | Fekete ..... 428/212 |
| 4,151,323 | A | | 4/1979 | Christie |
| 4,199,401 | A | | 4/1980 | Liu et al. |
| 4,427,734 | A | | 1/1984 | Johnson |
| 4,565,735 | A | | 1/1986 | Murka, Jr. et al. |
| 4,731,281 | A | | 3/1988 | Felischer et al. |
| 4,743,482 | A | | 5/1988 | Johansson et al. |
| 4,806,413 | A | * | 2/1989 | Penven ..... 428/222 |
| 4,842,929 | A | | 6/1989 | Dufour et al. |
| 5,888,915 | A | | 3/1999 | Denton et al. |
| 2004/0033748 | A1 | | 2/2004 | Crook |

FOREIGN PATENT DOCUMENTS

| | | |
|---|---|---|
| DE | 40 40 861 A1 | 12/1990 |
| EP | 88308268.7 | 3/1989 |
| WO | WO 02/33170 A1 | 4/2002 |

OTHER PUBLICATIONS

The Paper Machine Wet Press Manual, TAPPI Press, p. 54 (1991).*
http://en.wikipedia.org/wiki/Nylon.*
http://en.wikipedia.org/wiki/Polyethylene_terephthalate.*

* cited by examiner

*Primary Examiner*—Eric Hug
(74) *Attorney, Agent, or Firm*—McNair Law Firm, P.A.

(57) ABSTRACT

A paper makers felt comprising a fibrous outer layer formed of inter-engaged fibers of between 3.0 and 67 dtex inter-engaged preferably by needling, and a web layer formed of fibers which are between 200 and 600 dtex and are inter-engaged preferably by point bonding. The outer layer is engaged with the web layer, preferably by needling, forming a composite paper makers felt.

21 Claims, 3 Drawing Sheets

PAPERMAKERS FELT HAVING A POINT-BONDED WEB LAYER FORMED OF COARSE FIBERS

BACKGROUND OF THE INVENTION

It is known in papermaking felts to be advantageous to provide void volume which remains available through the nip so as to provide open area to receive water pressed out of the paper product sheet. The term paper product means paper or pulp.

While numerous efforts have been made to provide paper makers webs with ever improving void volume, along with felt resiliency, none appear to be totally satisfactory.

Accordingly, it is an object of the invention to provide improved consistency throughout area of void volume.

Another object of the invention is to provide a papermaking web with improved pressure uniformity.

Another object of the invention is to provide a papermaking web with improved resiliency.

Another object of the invention is the provision of a paper makers felt with improved rebound capability.

Still another object of the invention is the provision of a paper makers web which is inexpensive to produce.

SUMMARY OF THE INVENTION

The present invention is directed to a paper makers felt which includes a fibrous outer layer formed of inter-engaged fibers of between 3.0 and 67.0 dtex forming a smooth outer surface for supporting the paper forming material. A web layer which is preformed is constructed of randomly arranged inter-engaged fibers of between 200 and 600 dtex. The outer layer is arranged over, supported by and engaged with the web layer, forming the paper makers felt as a composite fabric. The fibers of the outer layer are inter-engaged preferably by needling, forming the support surface of the paper makers felt.

The fibers forming the web layer are preferably inter-engaged by thermal bonding or chemical point bonding. The preferred chemical bonding agents comprise a nitrile rubber or a polyurethane. The resulting web layer is an unusually strong, resilient, stable and porous structure.

The papermaking web may include a support layer which is formed of continuous filament yarns woven or coiled, forming a stable fabric of the support layer. The support layer provides increased longitudinal and lateral stability for the paper makers felt. The support fabric can also add to void volume and provide a machine seaming ability. The outer and web layers may be secured with the support layer by bonding, needling or a combination thereof.

The paper makers felt may include an intermediate layer which may be disposed between the support layer and the web layer or between the outer layer and the web layer. The intermediate layer comprises a scrim, woven or non-woven, fabric supporting on at least one surface of a fiber layer.

The web layer is normally between 0.07 mm and 1.5 mm thick in uncompressed condition. The fibers forming the web layer are between 25 mm and 120 mm in length and are from 200 to 600 dtex. The fibers forming the surface layer are between 25 mm and 90 mm in length and of a dtex between 3.3 and 22.0. Typically, the support layer weighs approximately 450 gsm, the web layer approximately 400 gsm, and the surface layer approximately 750 gsm.

The web layer is preferably a preformed felt or malt in which the forming fibers are bonded forming a longitudinally and laterally stable fabric.

The web layer may comprise a plurality of webs lapped one on the other and secured together by one of bonding and needling. The webs may extend in the same direction or in opposed transverse positions when stacked for lapping.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
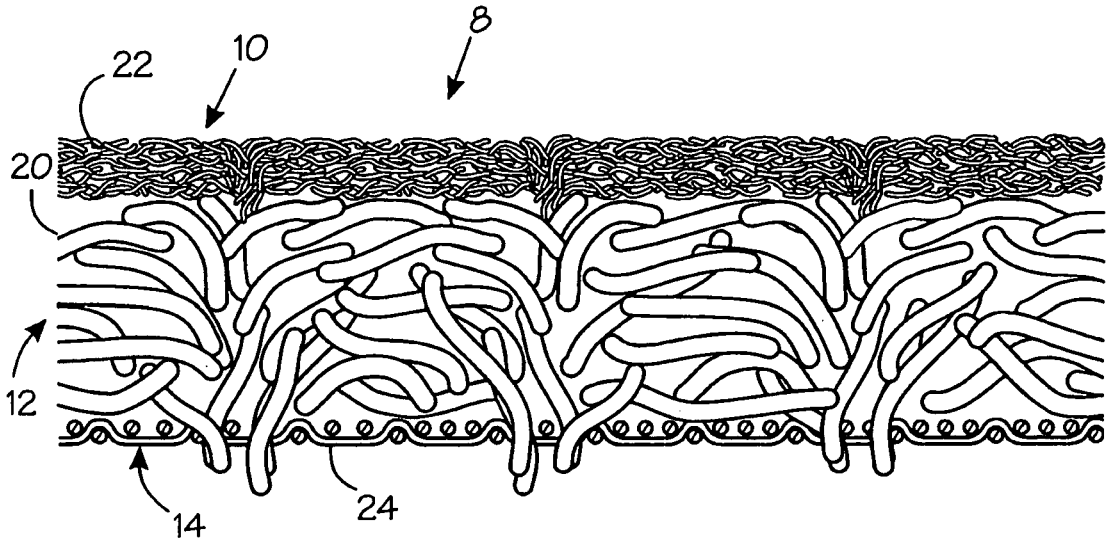
FIG. 1 is a side view of the papermaking fabric of the invention, needled.
Figure 2:
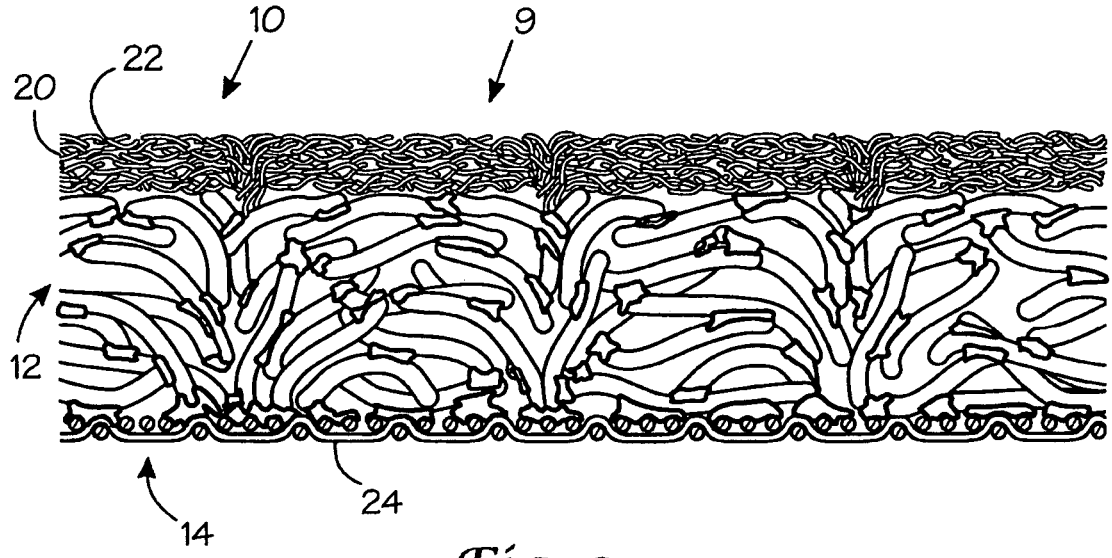
FIG. 2 is a side view of the papermaking fabric of the invention, bonded.
Figure 5:
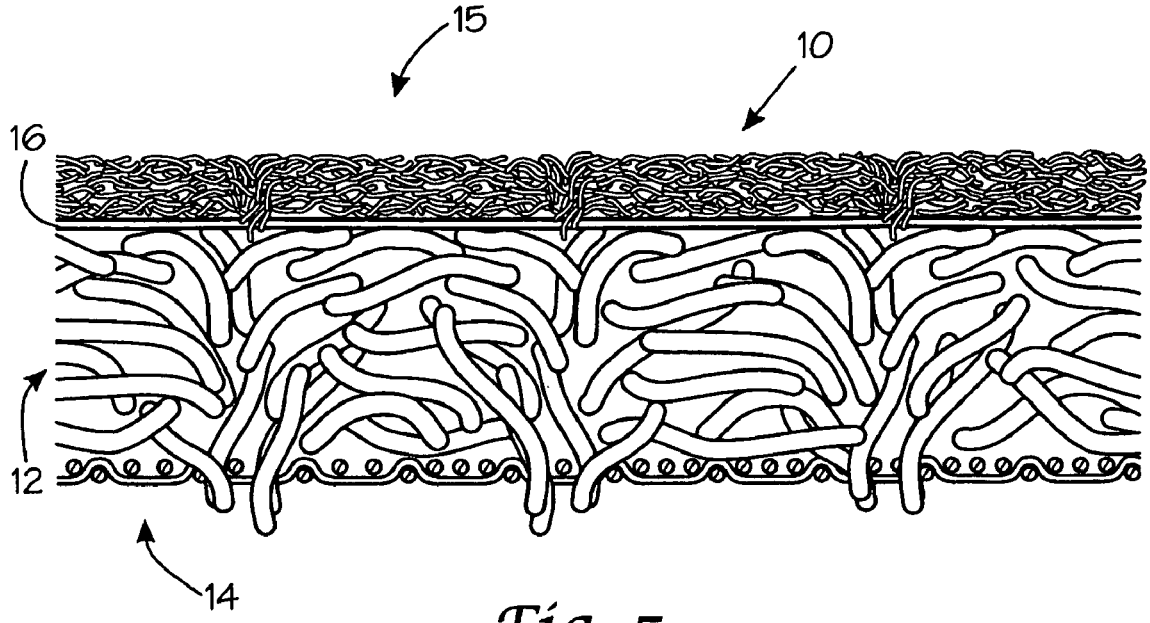
FIG. 5 is a side view of the papermaking fabric of the invention, with an intermediate layer.

FIGS. 1 and 2 are side views showing two preferred arrangements of the papermakers fabric of the instant invention. The structure illustrated in FIG. 1 is a papermakers felt 8 which comprise an outer layer 10, a web layer 12 and a support layer 14. The outer layer, web layer and support layer are engaged by needling. The structure shown in FIG. 2 is a paper makers felt 9 comprising an outer layer 10, a web layer 12 and a support layer 14. The outer layer, web layer and support layer are engaged by bonding. Another arrangement is shown in FIG. 5, which includes paper makers felt 15 comprising outer layer 10, web layer 12, support layer 14 and under layer or scrim fabric layer 16.

Turning now to FIG. 1, outer layer 10 is preferably formed of a carded web of nylon fibers 22 of about 17 dtex which are engaged preferably by needling. Fibers 22 may be between 3.3 dtex and 22 dtex. Alternatively, fibers 22 may be engaged by thermal or chemical bonding as shown in FIG. 2.

The outer layer, which provides even porosity, presents an outer surface which is substantially smooth. Outer layer 12 acts to support the paper product during drying. The generally smooth outer surface limits marking on the paper product.

Other suitable fibers for forming the outer layer could be polyesters or polyolefins.

Support layer 14 is formed of continuous filament nylon yarns 24 which may be monofilament or multi-filament. Yarns 24 are either woven or coiled in known manner to form a fabricated structure which is wear-resistant and stable, both transversely and longitudinally. Preferably, yarns 24 are between 0.30 mm and 0.75 mm diameter. Other polymeric resins such as polyester and polyolefin may be used to form support layer 14. In certain instances, support layer 14 may be omitted.

Figure 3:
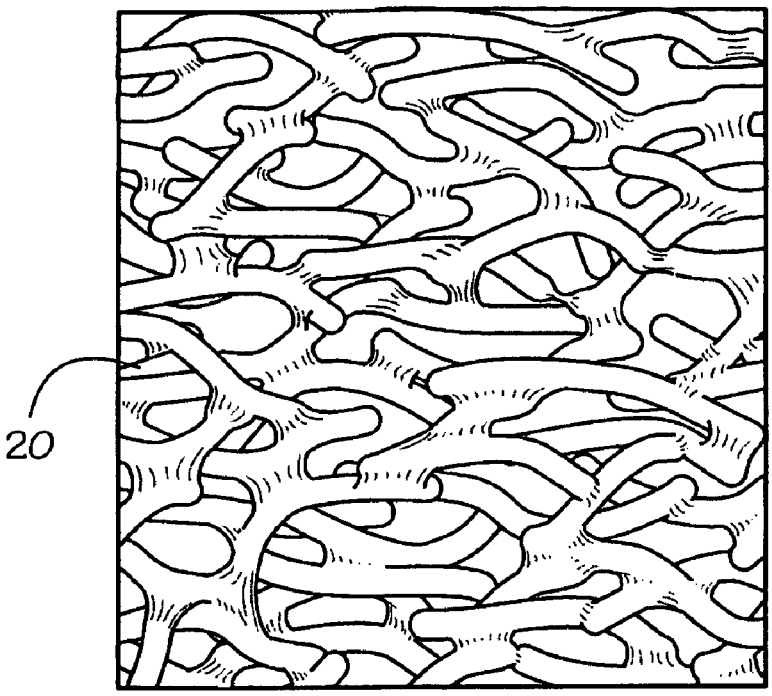
FIG. 3 is an exploded view of point, thermal bonded fibers.
Figure 4:
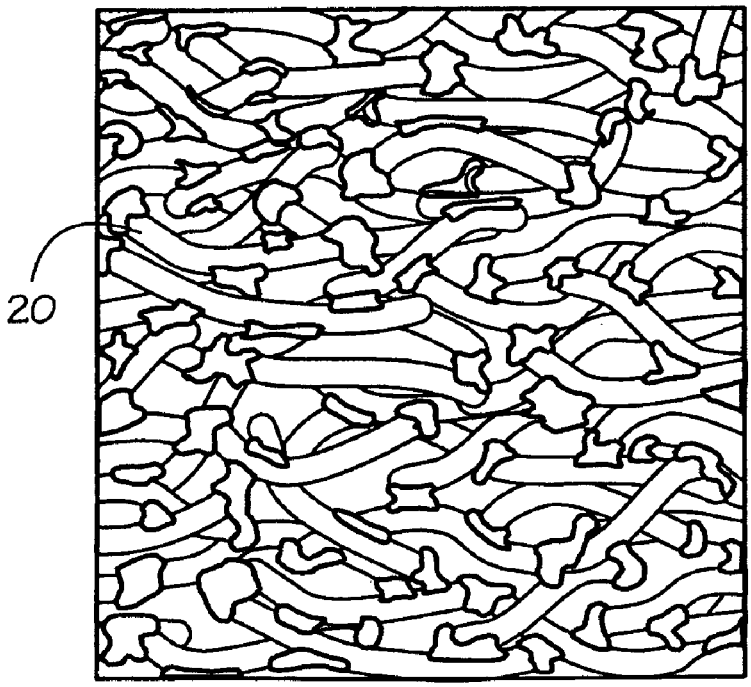
FIG. 4 is an exploded view of point, chemically bonded fibers.

Web layer 12 is preferably preformed of randomly arranged polyester fibers 20 of a size ranging between 200 to 600 dtex with a fiber length of between 25 and 90 mm. Other suitable polymeric resins are also acceptable for forming the web layer such as nylon and polyolefin. While the fibers are preferably arranged in a totally random manner, they could be arranged in predominant directions and still fall under the definition of random. Web forming fibers 20 are randomly arranged over the area of web 12, preferably by air layering and are inter-engaged by point thermal or chemical bonding using a nitrile rubber bonding agent as shown in FIGS. 3 and 4, forming the web into a multi-directional stable fabric. Other chemical bonding agents such as polyurethane, polyamide or polyurea may be used.

Web layer 12 may be formed by stacking or superimposing layers or sheets of randomly arranged fibers 20. The layers and the fibers are then inter-engaged by point bonding either chemically or thermally. If desired, alternate fiber layers or sheets may extend transverse of adjacent fiber layers prior to bonding. This arrangement provides increased multi-directional stability.

The resulting web has a resilient texture which has approximately 20% greater bulk than the usual web which is formed of fibers of no more than 60 dtex. A single layer web produced with chemical bonding provides exceedingly strong joint break strength and is capable of replacing multiple web layers of conventional webs. Web layer 12 has a density of about 0.40 gm/cm$^3$ which is about 15% lower than the density of a conventionally structured web. Also, by bonding, particularly chemical bonding, the use of large fibers for forming the web provides greater compact resistance and wear resistance. This allows for the web to be formed of low cost materials such as polyesters, and low molecular weight nylons, instead of high molecular weight nylon. This provides a cost savings of about 25-30%.

Web layer 12, produced with these lower cost fibers, still possesses improved long-term compaction resistance, increased wear resistance and resiliency over long-term use. Web layer 12 also maintains an even drainage capacity over its entire area after extended use.

Turning to FIGS. 3 and 4, point bonding by chemical and thermal treatment is shown. It is noted that the engaged fibers are held in spaced positions between the points of engagement providing excellent drainage channels.

To form paper makers fabrics 8 and 9, web layer 12, which has been formed by point bonding, is covered with outer layer 10. The fibers forming the outer layer may or may not be thoroughly inter-engaged at this time. During the positioning of outer layer 10 over web layer 12, the two are inter-engaged by bonding and/or needling.

Should it be desired, simultaneously with the combining of outer layer 10 with web layer 12, support layer 14 is positioned beneath the web layer. Layers 10, 12 and 14 may be inter-engaged simultaneously or separately by needling or thermal or chemical bonding. It is noted that web layer 12, so constructed, provides that the paper makers felt is less prone to mark the paper sheet as there may be no woven fabric having knuckles involved. The increased mass of the web layer also acts to contain fabric knuckles when woven support webs are utilized. Also, webs 12 may be applied over the seam of an on machine seam design paper makers fabric because it provides an improved "mask" over this area which reduces the potential of seam marks.

Turning now to FIG. 5, paper makers fabric 15 is shown as having a scrim fabric 16 interposed between outer layer 10 and web layer 12. Scrim 16 comprises a porous fabric formed of very small synthetic yarns formed of suitable polymeric resins by weaving or bonding yarns together to form a stabilizing structure. Scrim 16 is united with outer layer 10 and web layer 12 by needling or thermal or chemical bonding. The scrim can be used to enhance sheet drying, due to improved rewet resistance and/or micro pressure uniformity; improved resiliency, or greater void volume for dewatering applications, and improved long term caliper retention. Normally, the combined scrim, outer and web layers are also simultaneously united with support layer 14. In certain instances, the support layer may be omitted.

The paper makers felt as described provides superior durability while providing excellent drainage.

While a preferred embodiment of the invention has been described using specific terms, such description is for illustrative purposes only, and it is to be understood that changes and variations may be made without departing from the spirit or scope of the following claims.

What is claimed is:

1. A papermakers felt comprising:

a fibrous outer layer formed of inter-engaged fibers of between 3.0 and 67 dtex;

a web layer formed of inter-engaged fibers of between 200 and 600 dtex randomly arranged;

said outer layer being engaged with the web layer forming a composite papermakers felt; wherein the fibers of the web layer are inter-engaged by one of thermal and chemical bonding.

2. The felt of claim 1 wherein the outer layer is engaged with the web layer by needling.

3. The felt of claim 1 wherein said papermakers felt is between 2.2 mm and 3.8 mm thickness in uncompressed condition.

4. The felt of claim 1 wherein the fibers of the outer layer are inter-engaged by needling.

5. The felt of claim 1 wherein a chemical bonding agent comprises one of a nitrile rubber and polyurethane.

6. The felt of claim 1 including a support layer formed of continuous filament yarns, said outer layer and said web layer being secured with said support layer.

7. The felt of claim 6 wherein at least two of said outer, web and support layers are secured together by needling.

8. The felt of claim 6 wherein at least two of said outer, web and support layers are secured together by one of chemical and thermal bonding.

9. The felt of claim 6 wherein said support layer comprises a coiled fabric.

10. The felt of claim 6 wherein said support layer comprises a woven fabric.

11. The felt of claim 1 including an under layer engaged with said web layer, said outer layer, web layer and under layer comprising said paper makers fabric.

12. The felt of claim 11 wherein said under layer comprises a scrim fabric.

13. The felt of claim 11 including a support fabric supporting said outer layer, web layer and under layer.

14. The felt of claim 1 wherein said web layer is between 10 mm and 1.5 mm thick in uncompressed condition.

15. The felt of claim 6 wherein said yarns forming said support layer are between 0.3 mm and 0.75 mm diameter.

16. The felt of claim 1 wherein the fibers forming said web layer are between 25 and 90 mm in length.

17. The felt of claim 1 wherein said web layer comprises a plurality of webs lapped and secured together by one of bonding and needling.

18. The felt of claim 1, wherein said fibers forming said web layer are polyester.

19. A papermakers felt comprising:

a fibrous outer layer formed of inter-engaged fibers of between 3.0 and 67 dtex;

a web layer formed of inter-engaged fibers of between 200 and 600 dtex randomly arranged;

said outer aver being engaged with the web layer forming a composite papersmakers felt; wherein, said web layer has a density of about 0.40 gm/cm$^3$.

20. A method of forming a multi-layer paper makers felt comprising:

forming a web of fibers of between 200 and 600 dtex and inter-engaging said fibers by one of thermal and chemical bonding forming a web layer;

arranging a layer of fibers of between 3.0 and 67 dtex over an upper surface of said web layer and inter-engaging said fibers with said web layer forming an outer layer integral with and over said upper surface of said web layer, wherein said combined outer layer and web layer form said paper makers felt.

21. The method of claim 20 including forming a support layer of continuous filament yarns and inter-engaging said support layer with a lower surface of said web layer.

* * * * *